US006886731B1

(12) United States Patent
Chang

(10) Patent No.: US 6,886,731 B1
(45) Date of Patent: May 3, 2005

(54) END CAP SECURING DEVICE FOR PNEUMATIC TOOLS

(76) Inventor: Wen-Chou Chang, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/412,965

(22) Filed: Apr. 14, 2003

(51) Int. Cl.[7] ..... B25C 1/04
(52) U.S. Cl. ..... 227/130
(58) Field of Search ..... 227/130, 10, 8, 227/9; 123/46 SC

(56) References Cited

U.S. PATENT DOCUMENTS 3,774,293 A * 11/1973 Golsch ..... 29/432.1
3,895,562 A * 7/1975 El Guindy ..... 91/308
4,609,135 A * 9/1986 Elliesen ..... 227/130
6,059,167 A * 5/2000 Ho et al. ..... 227/130
6,296,168 B1 * 10/2001 Hung ..... 227/130
6,533,156 B1 * 3/2003 Chang ..... 227/130
6,626,081 B2 * 9/2003 Ho et al. ..... 91/394

* cited by examiner

*Primary Examiner*—Scott A. Smith
(74) *Attorney, Agent, or Firm*—Charles E. Baxley

(57) ABSTRACT

A pneumatic tool includes a barrel having a nose connected to a front end and a handle connected to the barrel. A threaded area is defined in an outer periphery of the barrel and a sealing plate and an end cap are respectively mounted to a rear end of the barrel. The end cap has a first flange extending outward therefrom. A securing member is threadedly connected to the threaded area of the barrel and a second flange extends inward from the securing member. The second flange presses the first flange so as to force the sealing plate onto the rear end of the barrel without using a bolt.

3 Claims, 6 Drawing Sheets

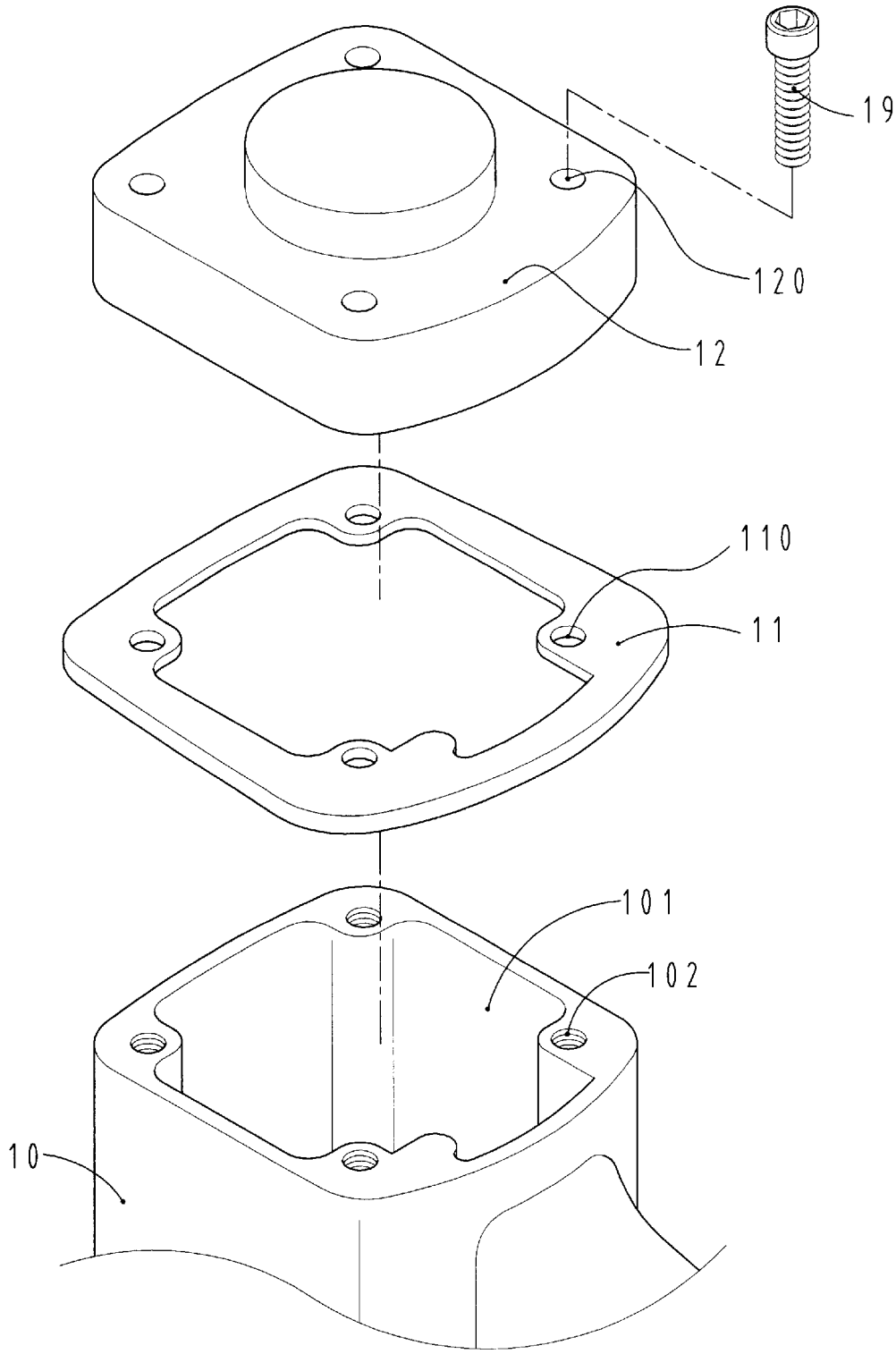
FIG. ONE
PRIOR ART

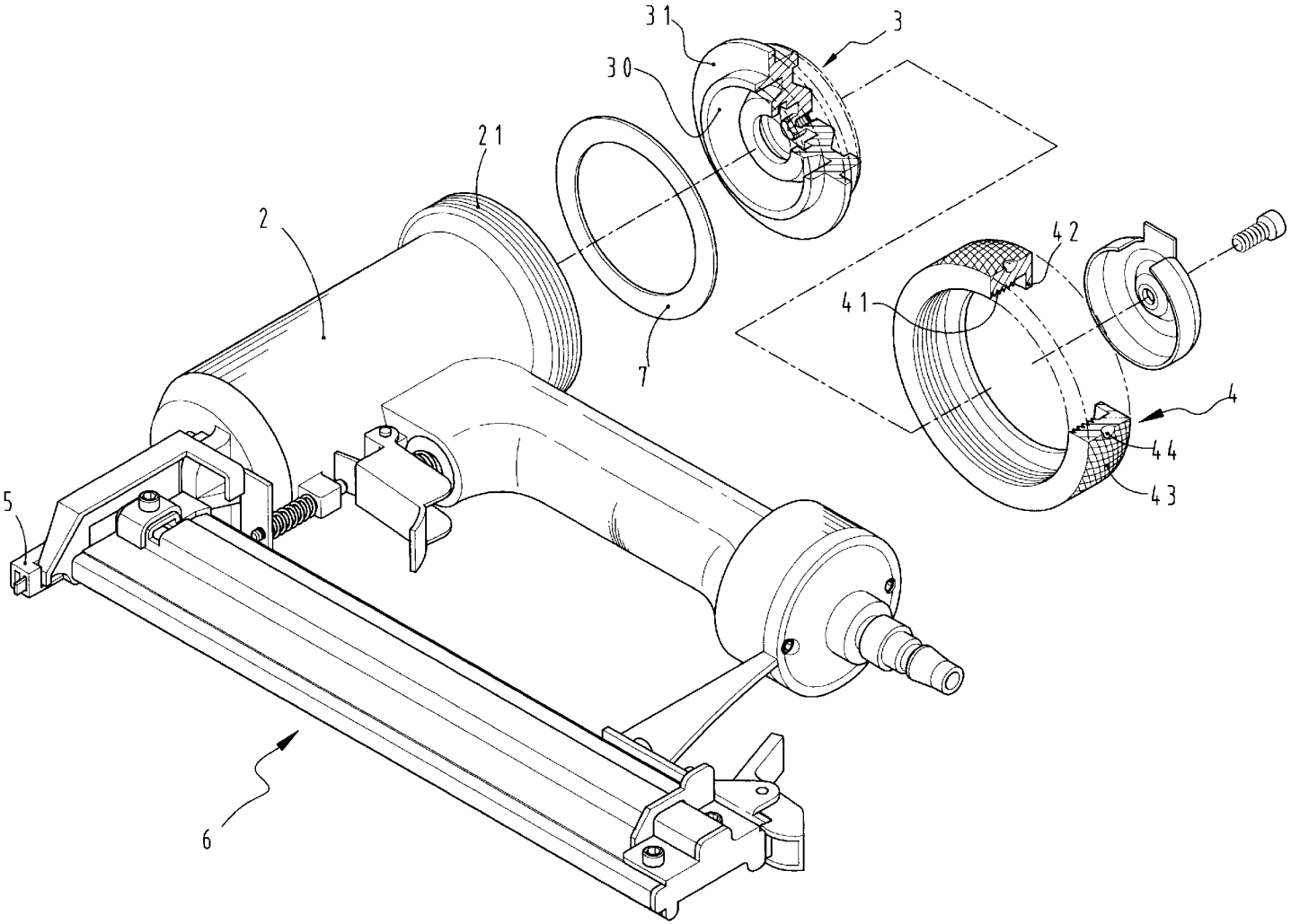
FIG. TWO

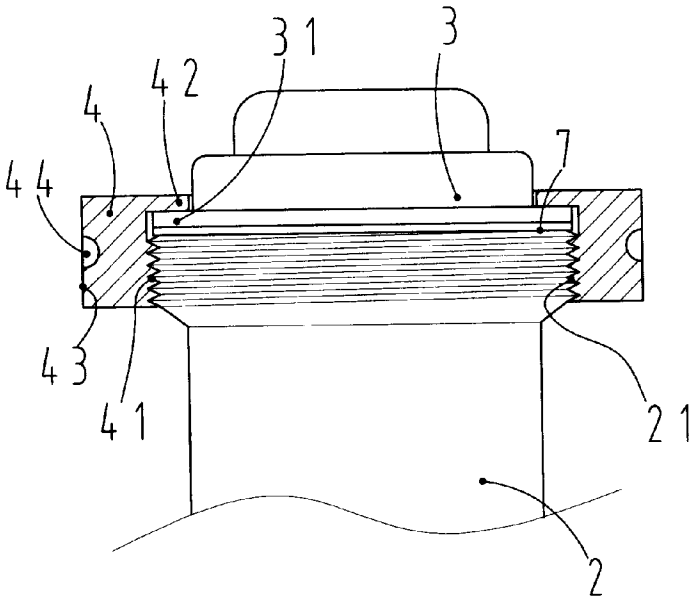
FIG. THREE
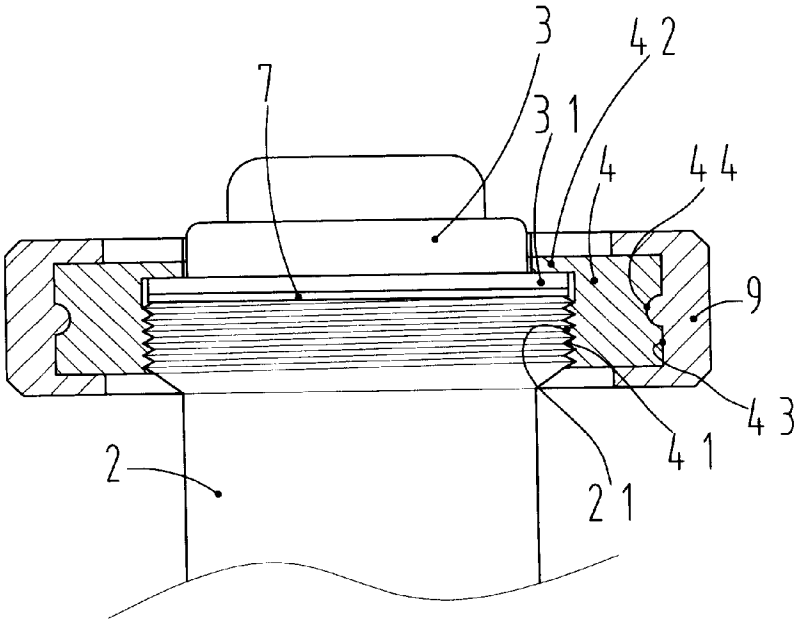
FIG. SIX

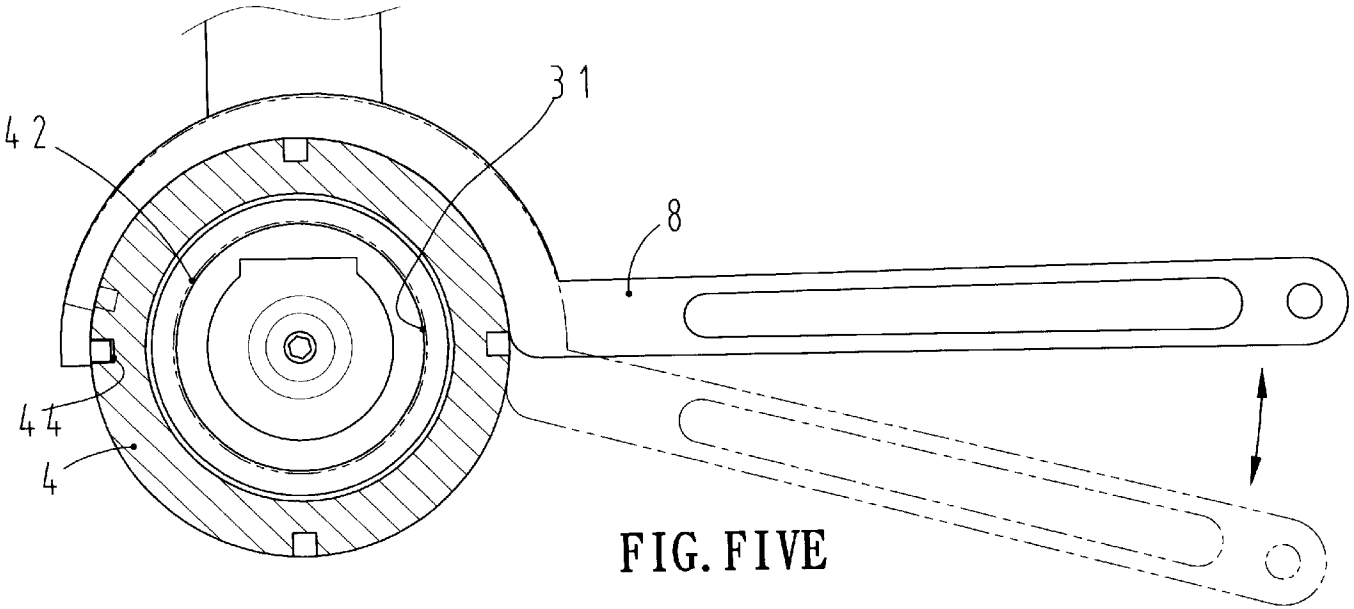
FIG. FIVE
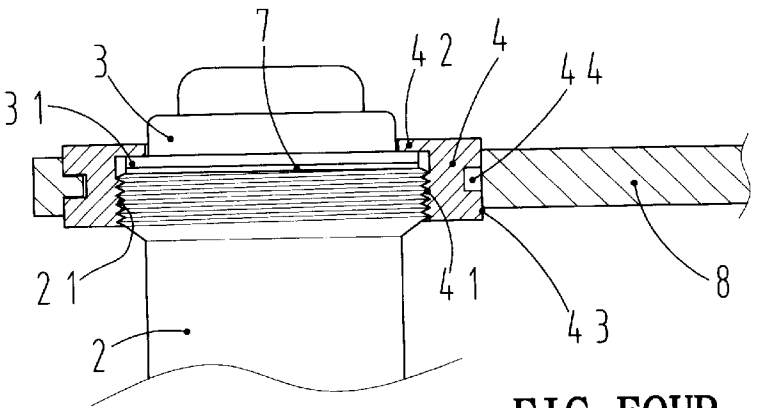
FIG. FOUR

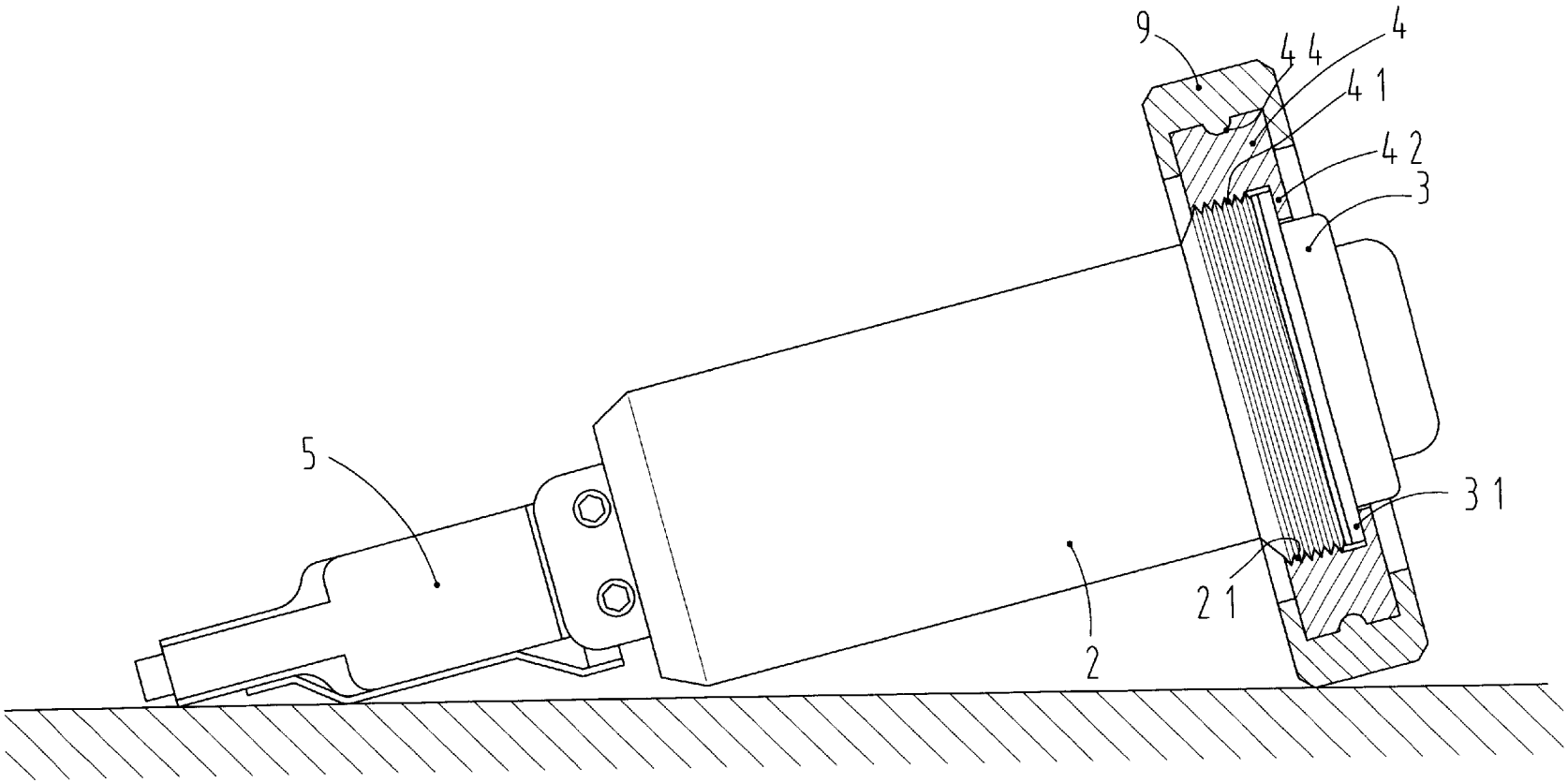
FIG. SEVEN

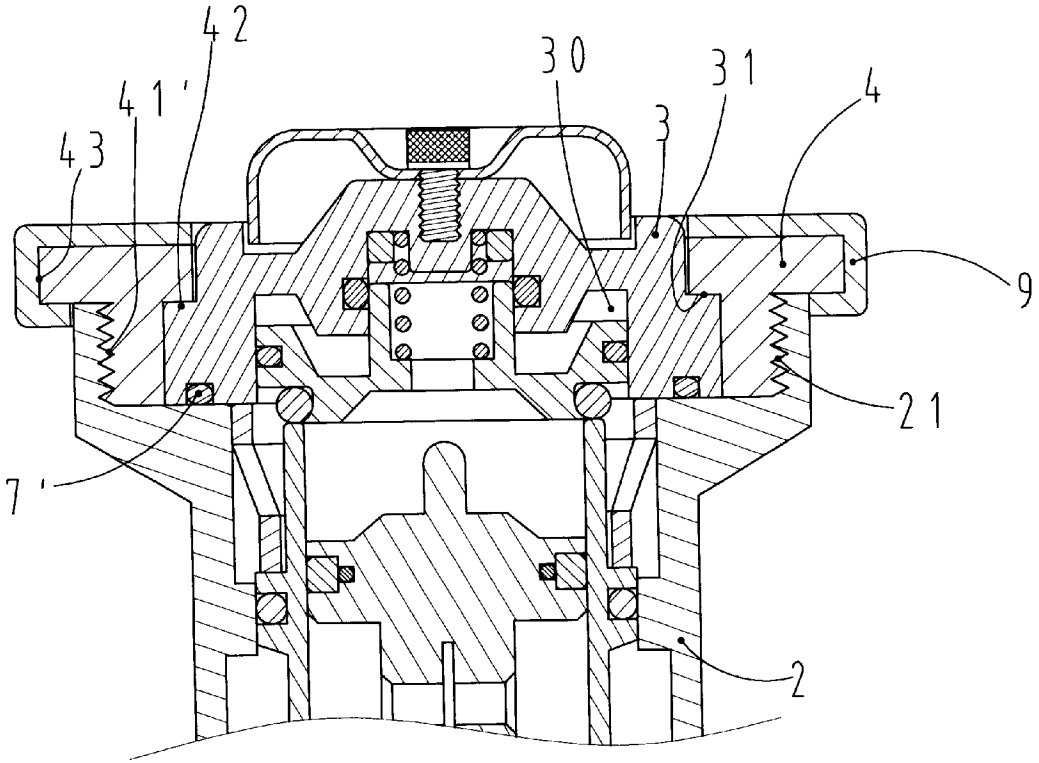
FIG. EIGHT

END CAP SECURING DEVICE FOR PNEUMATIC TOOLS

FIELD OF THE INVENTION

The present invention relates to a securing member threadedly connected to an end of a pneumatic tool so as to force an end cap in position without using bolts.

BACKGROUND OF THE INVENTION

Referring to FIG. 1, a conventional pneumatic tool generally includes a barrel 10 in which a chamber 101 is defined and an end cap 12 is secured to an rear end of the barrel 10 to seal the opening of the barrel 10. In order to position the end plate 12, the rear end of the barrel 10 has four threaded holes 102 and bolts 19 extend through four holes 120 defined through the end cap 12 and holes 110 defined through a sealing plate 11 and then are threadedly engaged with the threaded holes 102 so securely connect the end cap 12 to the rear end of the barrel 10. The conventional way has to drill threaded holes 102 in the limited area of the rear end of the barrel 10 and the head of the bolts 19 exposed out from the end cap 12 makes the appearance of the pneumatic tool not to be smooth or linear.

The present invention intends to provide a securing member that is threadedly connected to the barrel so as to securely position the end in position without using bolts and without requiring drilling in the rear end of the barrel.

SUMMARY OF THE INVENTION

In accordance with one aspect of the present invention, there is provided a pneumatic tool that comprises a barrel having a nose connected to a front end of the barrel and a handle is connected to the barrel. A threaded area is defined in the barrel. A sealing plate is mounted to a rear end of the barrel and an end cap is mounted to the sealing plate, The end cap has a first flange extending outward therefrom. A securing member is threadedly connected to the threaded area of the barrel and a second flange extends inward from the securing member and presses the first flange.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show a conventional end cap, a sealing plate and a barrel of a pneumatic tool;

FIG. 2 is an exploded view to show an end cap, a sealing plate, a barrel and a securing member of the present invention;

FIG. 3 is a cross sectional view to show the securing pressing the end cap to the barrel of the present invention;

FIGS. 4 and 5 shows a tool is used to secure the securing member of the present invention;

FIG. 6 shows a protection ring is mounted to the outer periphery of the securing member;

FIG. 7 shows the protection ring protects the securing member from being contact with foreign objects, and FIG. 8 is a cross sectional view to show the other embodiment off the end cap, the sealing plate, the barrel and the securing member of the present invention.

DETAILED DESCRIPTION OF THE PREFERRED EMBODIMENT

Referring to FIGS. 2 and 3; the pneumatic tool of the present invention comprises a barrel 2 having a nose connected to a front end of the barrel 2 through which staples are ejected therefrom, and a handle is connected to the barrel 2 so as to be connected to a pressurized air source (not shown). A magazine 6 is connected to the nose 5 so as to provide the staples. A threaded area 21 is defined in an outer periphery of the barrel 2.

A sealing plate 7 is mounted to a rear end of the barrel 2 and an end cap 3 is mounted to the sealing plate 7. The end cap 3 has a first flange 31 extending outward therefrom and a receiving area 30 is defined in a side of the end cap 3. A securing member 4 has an inner threaded area 41 which is threadedly connected to the threaded area 21 of the barrel 2 and a second flange 42 extends inward from the securing member 4. The second flange 42 presses the first flange 31 of the end cap 3 so as to press the sealing plate 7 in position. A knurl surface 43 is defined in the outer periphery of the securing member 4 so that the user may secure the securing member 4 by easily grasping the knurl surface 43.

Further referring to FIGS. 4 and 5, the securing member 4 has a plurality of recesses 44 defined in an outer periphery thereof so that a tool 8 is used to engage two of the recesses 44 and rotate the securing member 4. This allows the assemblers to easily secure the securing member 4 within a short period of time.

Referring to FIGS. 6 and 7, a protection ring 9 made of plastic material is mounted to the outer periphery of the securing member 4 so as to protect the securing member 4 from being in contact with foreign objects.

FIG. 8 shows the other embodiment of the present invention, wherein the threaded area 21 is defined in an inner periphery of a skirt portion of the barrel 2 and the securing member 4 has an outer threaded area 41' which is threadedly connected to the threaded area 21 of the barrel 2. The second flange 42 still presses the first flange 31 of the end cap 3 so as to press a sealing ring 7' in position.

By this arrangement, no bolt is required and no threaded hole is needed.

While we have shown and described the embodiment in accordance with the present invention, it should be clear to those skilled in the art that further embodiments may be made without departing from the scope of the present invention.

What is claimed is:

1. A pneumatic tool comprising:

a barrel having a nose connected to a front end of the barrel and a handle connected to the barrel, a threaded area defined in the barrel;

a sealing plate mounted to a rear end of the barrel and an end cap mounted to the sealing plate, the end cap having a first flange extending outward therefrom, and a securing member threadedly connected to the threaded area of the barrel and a second flange extending inward from the securing member, the second flange pressing the first flange.

2. The pneumatic tool as claimed in claim 1, wherein the securing member has a plurality of recesses defined in an outer periphery thereof.

3. The pneumatic tool as claimed in claim 1, wherein a protection ring is mounted to the outer periphery of the securing member.

* * * * *